US006446555B1

(12) United States Patent
Schramm et al.

(10) Patent No.: US 6,446,555 B1
(45) Date of Patent: Sep. 10, 2002

(54) APPARATUS FOR THE DENSITOMETRY MEASUREMENT OF PRINTED PRODUCTS

(75) Inventors: Peter Schramm, Frankfurt am Main; Joachim Muller, Pullach, both of (DE)

(73) Assignee: Man Roland Druckmaschinen AG (DE)

( * ) Notice: Subject to any disclaimer, the term of this patent is extended or adjusted under 35 U.S.C. 154(b) by 194 days.

(21) Appl. No.: 09/662,916

(22) Filed: Sep. 15, 2000

(30) Foreign Application Priority Data

Sep. 17, 1999 (DE) ..... 299 16 379

(51) Int. Cl.[7] ..... B41F 31/02

(52) U.S. Cl. ..... 101/365; 101/211; 101/484; 101/350.1; 382/112

(58) Field of Search ..... 101/350.1, 365, 101/366, 181, 484, 211; 382/112

(56) References Cited

U.S. PATENT DOCUMENTS

| | | | | | |
|---|---|---|---|---|---|
| 4,200,932 | A | * | 4/1980 | Schramm et al. | 101/350.1 |
| 4,428,287 | A | * | 1/1984 | Greiner | 101/350.1 |
| 4,570,539 | A | * | 2/1986 | Rottstedt | 101/365 |
| 4,665,496 | A | * | 5/1987 | Ott | 101/365 |
| 4,881,181 | A | * | 11/1989 | Jeschke et al. | 101/365 |
| 4,947,746 | A | * | 8/1990 | Jeschke et al. | 101/211 |
| 4,975,862 | A | * | 12/1990 | Keller et al. | 101/211 |
| 5,182,721 | A | * | 1/1993 | Kipphan et al. | 382/112 |
| 5,224,421 | A | * | 7/1993 | Doherty | 101/211 |
| 5,357,448 | A | * | 10/1994 | Stanford | 382/112 |
| 5,460,090 | A | * | 10/1995 | Pfeiffer et al. | 101/365 |
| 5,967,050 | A | * | 10/1999 | Seymour | 101/484 |
| 5,992,318 | A | * | 11/1999 | DiBello et al. | 101/181 |
| 6,058,201 | A | * | 5/2000 | Sikes et al. | 382/112 |
| 6,119,594 | A | * | 9/2000 | Kipphan et al. | 101/365 |
| 6,142,078 | A | * | 11/2000 | Lachajewski | 101/365 |
| 6,318,260 | B1 | * | 11/2001 | Chu et al. | 101/365 |

FOREIGN PATENT DOCUMENTS

| | | |
|---|---|---|
| EP | 0 274 061 B1 | 11/1995 |
| EP | 0 370 126 B1 | 9/1996 |

* cited by examiner

*Primary Examiner*—Eugene Eickholt
(74) *Attorney, Agent, or Firm*—Leydig, Voit & Mayer, Ltd.

(57) ABSTRACT

An apparatus is described for the densitometric measurement of printed products such as sheets printed by sheet-fed offset printing machines, having a densitometer measuring head. The head moves along a measurement strip comprising a number of measurement fields and generates signals that are converted into ink density values in a downstream evaluation unit, which is assigned to ink metering zones. The evaluation unit comprising a computer that contains stored information about the arrangement of the measurement fields of the printed colors in each metering zone. The ink density values from one measurement field are compared with the ink density values from neighboring measurement fields of the same color and type in accordance with the known structure of the measurement strip. The invention provides for the simple and fail-safe arrangement of the measurement-field colors in the individual ink metering zones.

3 Claims, 4 Drawing Sheets

APPARATUS FOR THE DENSITOMETRY MEASUREMENT OF PRINTED PRODUCTS

TECHNICAL FIELD OF THE INVENTION

This invention relates to an apparatus for the densitometry measurement of printed products.

BACKGROUND OF THE INVENTION

Densitometers are used to control the quality of printing products by, for example, providing density values to control the feeding of ink by metering devices. To measure the density values, a measurement strip comprising a series of measurement fields assigned to different colors is printed alongside the printed image on the same sheet. In products printed by sheet-fed offset printing, the strips are printed at the beginning or the end of the printing procedure. In addition to being inspected visually as it is removed from the deliverer and placed on an underlay, a printed sheet with a measurement strip is also measured by a traversing densitometer. Thus, the ink density values associated with different colors in the measurement fields are measured and accumulated.

The structure of the measurement strips comprises zones that correspond to zones of ink metering in a printing machine. In general, an ink-metering zone marks a section comprising a series of measurement fields. The structure of a measurement strip provides information of the number of measurement fields in each ink-metering zone and the arrangement of the color densities in the zone.

For a given measurement strip, the pattern of colors in the series of measurement fields in an ink-metering zone may vary from zone to zone. For example, in one ink-metering zone the color cyan is assigned the third measurement field and in another zone the color cyan is assigned to the fifth measurement field. In this case, the measurement field for cyan may be located at the edge in one ink-metering zone and close to the center in the other zone.

The primary colors (cyan, magenta, yellow and black) are formed as either full-tone or halftone. Special colors can also be assigned to the measurement fields in the same ink-metering zone.

To measure the measurement strips described above, automatic densitometers with traversing measurement heads are employed. Densitometers of this type have been known for a long time, such as for example the CCI product from the Man Roland Druckmaschinen A G. With these automatic densitometers, a sheet to be measured is laid on the desk and aligned with stops. In a traversing of the strip, the positions of the measurement fields in each of the zones are determined and memorized. In a second traversing of the strip, the densitometry values obtained by corresponding densitometry filters are recorded and stored. The measured densitometry values are compared to predefined values. The results of the comparison are used to automatically adjust the ink-metering elements, each of which are associated with one of the ink metering zones.

The length of the measurement strip, especially the measurement fields assigned with individual colors within an ink-metering zone, extends to the maximum printing format (printing width). If the measurement strip is used for printed products having a format smaller than the maximum, the starting point of the measurement strip, which is the position from the center of the printing machine, does not coincide with the first ink-metering zone. Instead the strip may align its measurement field in such a way that the order of the colors are different than that expected, assuming the maximum format. In this situation, the limits of measurement fields with different colors and the optimum measurement position in the measurement fields can be determined by comparing the ink density values obtained from corresponding filters in a measurement run. But it still cannot determine which ink metering zone is assigned to the first measurement field.

Without additional information about the location of the fields, the densitometer and its associated control system for controlling the ink metering devices cannot determine the format width to use with the measurement strip. For this reason, known ink density measuring systems, in particular the densitometry system described above, have different modes of arranging the colors of the measurement fields between ink-metering zones, which can be taken into account in evaluating the measured data. One possibility for this is the identification of a field by analyzing the ink density values obtained by the various filters. As is known from the German Patent No. EP 0 370 126 B1, measurement fields of different color orders can be distinguished by comparing the ink density values obtained by the various filters (sensor channels). On the basis of this principle, it is possible to determine the structure of an unknown measurement strip by means of one measurement run, but this presupposes a previous detection run. One method for determining the optimum measurement position within a measurement field is described in European Patent No. EP 0274 061 B1.

One further possibility for taking into account the different arrangments of measurement fields in individual metering zones, which arises in the case of different formats, is to manually input where or in which zone the first (e.g., the cyan-colored) measurement field is located. For example, before measuring a first sheet, the operator inputs to the measurement system, via an appropriate input device, the fact that in the given format and in the measurement direction of the densitometer, the cyan measurement field is located in the first zone of the sheet at position 3 or that, in the measurement direction of the densitometer, the first measurement field of the zone on the extreme left has, for example, the color magenta. By way of this information, which has to be manually input, it is possible, taking into account the known measurement-strip structure (i.e., the arrangement of the individual measurement fields of different colors in the various metering zones) to determine the metering zone in which the measurement strip begins.

The possibilities outlined above for manually taking into account color measurement strips arranged in accordance with the printing-material format has the drawback that, as a result of incorrect input, incorrect measured values are obtained, or the measured values obtained cannot be assigned to the corresponding ink-metering zones. The derivation of actuating commands for controlling the zonal ink feeding is then not possible. In addition, any detection runs that may be needed are disadvantageous because of the additional expenditure of time.

SUMMARY OF THE INVENTION

The object of the present invention is, therefore, to expand a device for the densitometer measurement of printed products to the effect that a simple and fail-safe assignment of the measurement-field colors arranged in the individual ink metering zones is possible.

The invention provides for an evaluation unit that is connected downstream of the densitometer and comprises a computing device to compare the ink density values from one measurement field with the neighboring measurement fields of the same color and type (full-tone or half-tone) of measurement field. At the same time, it is taken into account that, within one measurement strip of known structure, the arrangement of the measurement fields assigned, for example, to the printing ink color cyan is known over the entire maximum format width and is different from zone to zone. On the basis of the knowledge of the structure of the measurement strip for the maximum format, the ink density value obtained on one measurement field of the color cyan is compared with the ink density value from the cyan measurement field in the zone N+1. The ink density profile runs smoothly over the width of the strip because of the ink cross-flow and in particular the ink distribution in offset printing machines. In other words, the ink density values of the cyan measurement fields in the metering zones N−1, N, N+1 do not exhibit any large steps in relationship to one another.

According to the invention, then, for the existing measurement fields in the metering zones, in conjunction with the known structure of the measurement strip, the ink density value of each color of one type of measurement field (full-tone or halftone) is compared with the density values of the same color from the neighboring fields. For this purpose, it is initially assumed that the measurement field considered in each case (e.g., cyan) is located in the first ink-metering zone. On the basis of the known measurement-strip structure, the distance to the cyan measurement field in the second metering zone is then determinable by the distance of a specific number of measurement fields derived from the known structure of the strip. Corresponding distances result from the predefined measurement-strip structure for the third, fourth and the further cyan measurement fields.

If the first measurement field measured for the color cyan is not located in the first ink-metering zone (max. printing format) but in the zone X, then the above-mentioned comparison leads to the ink density value of the cyan measurement field being compared with an ink density value of a different color. But then the compared ink density values do not fit one another and have a relatively large difference. Only when the locations of the measurement field of the same color in neighboring measurement zones correspond exactly with one another do the resulting ink density values, which on account of the ink cross-flow and the lateral distribution, exhibit a corresponding, smooth profile in relationship to one another.

If the successive ink density values from a measurement strip are interpreted correctly on the basis of the known strip structure, then, according to the invention, the result for all the fields of the same color is a smooth density profile. In other words, the ink density values exhibit small differences from their respective neighboring fields. On the other hand, a wrong interpretation of the ink density values supplies an abruptly changing density profile, since in this case the ink density values of different colors are compared with one another. If the sequence of measured values is shifted, that is to say the sequence of the arrangement of the measurement fields assigned to the individual colors is shifted along the known strip structure, then, within one repeated sequence (period of the measurement strip) a smooth density profile results only once. In this way, all the measured values can be assigned unambiguously to one field of the measurement strip. It is therefore possible to establish that the first measurement field of the measurement strip is located in zone X and that the first cyan measurement field is located in just this zone.

Preferably, provision is made for the variable $4\cdot(D_{n+1}-D_n)^2/(D_{n+1}+D_n)^2$ to be calculated for all the neighboring measurement fields. This variable describes the square of the relative change in density between two neighboring density values. For each inking unit, the average of this variable is calculated, and the average for all the printed colors of the measurement strip is calculated from all the averages. The result obtained in this way is a characteristic variable relating to the smoothness of the density profile. If, then, for all the possible combinations between measured values and the known strip structure, the smoothness characteristic variables are calculated, the result is a minimum for one single combination. This minimum combination corresponds to the actual field assignment. The calculation of the minimum combination is carried out in the computing device according to the invention that, as a result, supplies the measured values (ink density values) in correct association with the printing units and the ink metering zones of the inking units. In order to avoid density values of unoccupied measurement fields (paper white) being compared with one another, before the above-mentioned formula is applied, a check is first made as to whether or not a density value is present at all for a color.

Provision can also be made for the variation in the field shift corresponding to the structure of the measurement strip in both directions from a reference field. That is to say, starting from a measurement field assigned to one color in any desired ink-metering zone, the measured-values of other fields that are assigned to the color are varied in both directions in accordance with the known strip structure in order to calculate the density change outlined above. This approach makes it possible for a further input to be dispensed with as well, specifically determining whether the measurement strip is assigned to the leading edge or the trailing edge of the printed sheet (print start/print end).

As a result of the device according to the invention, it is unnecessary for an operator to perform any assignment of the first measurement field/metering zone to be input via operating elements. Thus, misinterpretation and erroneous assignments of measured values to ink metering zones are eliminated. Additional features and advantages of the invention will be made apparent from the following detailed description of illustrative embodiments that proceeds with reference to the accompanying figures.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings:

DETAILED DESCRIPTION OF THE INVENTION

Figure 1:
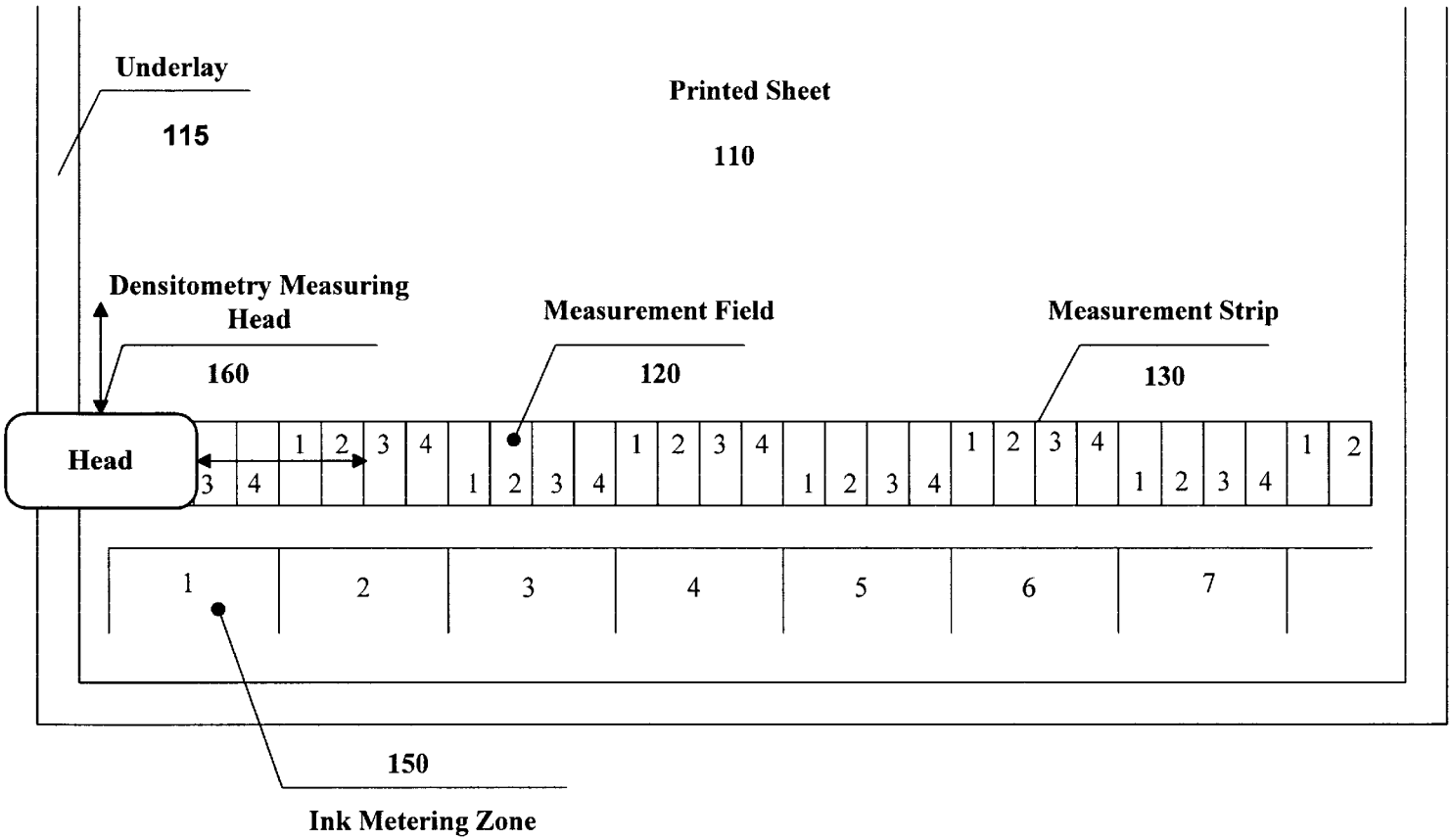
FIG. 1 shows an exemplary ink density measuring system for incorporating the invention.

Turning to the drawings and referring to FIG. 1, a printed sheet 110 produced by a sheet-fed offset printing machine (not illustrated) is laid on an underlay 115 for visual inspection and measurement.

Near the edge of the printed sheet 110, a measurement strip 130 is printed as well. The measurement strip 130 comprises a large number of measurement fields 120, which are assigned to individual colors during printing. Sequences of measurement fields are marked by a series of ink metering zones 150. Therefore the printed sheet 110 can also be assessed with regard to the zonal assignment.

The arrangement of the measurement fields 120 of individual colors in the measurement strip 130 is predefined. This means that, for example, the color cyan is located in the measurement field number 2 in the metering zone number 3. In metering zone number 4, the color cyan is located in the measurement field number 4. This arrangement applies to all types of colors assigned to the measurement fields.

The printed sheet 110 with measurement strip 130 is scanned by a traversing densitometry measuring head 160, which is attached to a conventional suspension fixture (not illustrated). The measuring head 160 can be moved along over the printed sheet 110 and perpendicular to the direction in which the measurement strip 130 extends as indicated by an arrow in FIG. 1.

Figure 2:
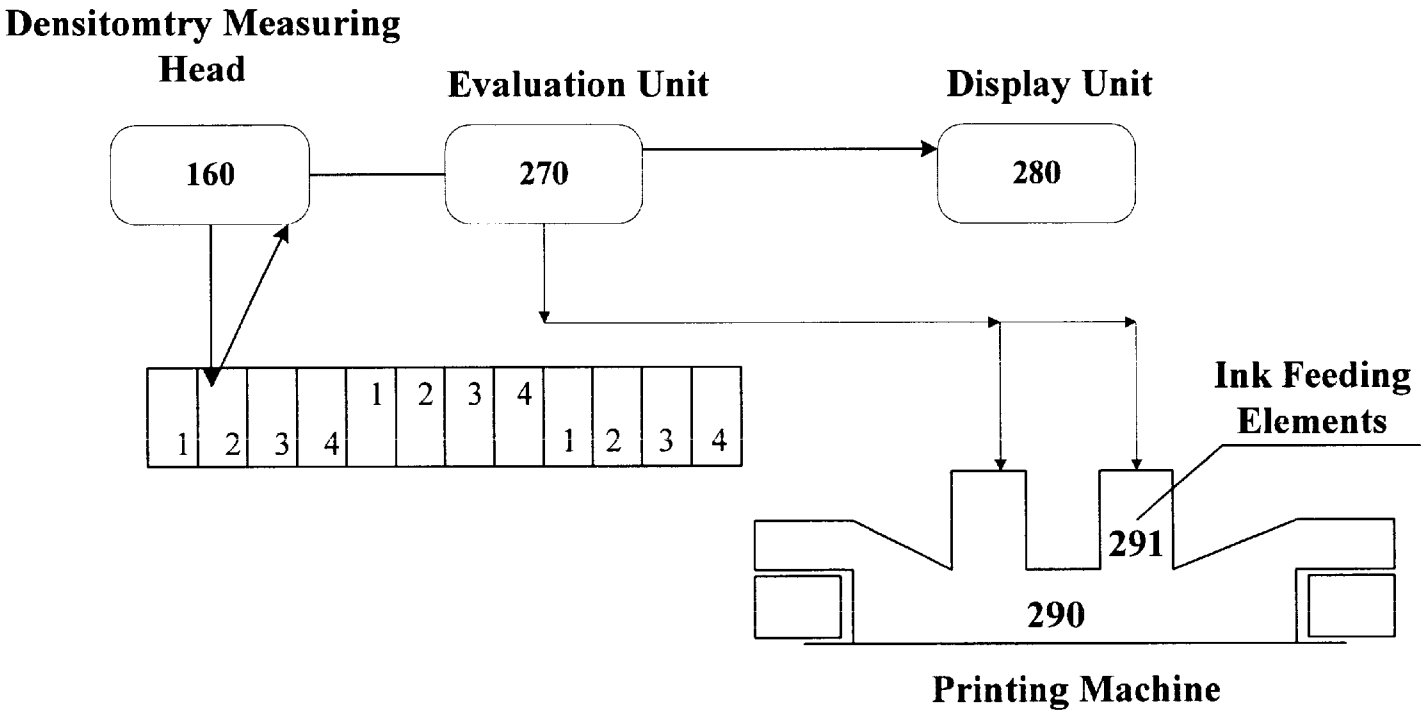
FIG. 2 illustrates the components of an ink density measuring system according to the invention, including an evaluation unit that receives density values from a measuring head.

Referring to FIG. 2, an evaluation unit 270 is connected downstream to the densitometry measuring head 160. The accumulated data of the measurement fields from the densitometry measuring head 160 are fed to the evaluation unit 270, which is constructed as a conventional computer such as a PC or workstation running a well-known operating system such as WINDOWS NT operating system by Microsoft Corporation or UNIX. A display unit 280 is operationally connected to the evaluation unit 270. The densitometry-measured data are compared with expected values and processed by the evaluation unit. Results from the evaluation unit 270 are fed into the ink feeding elements 291 in the printing machine 290 and are displayed by the display unit 280.

Figure 3:
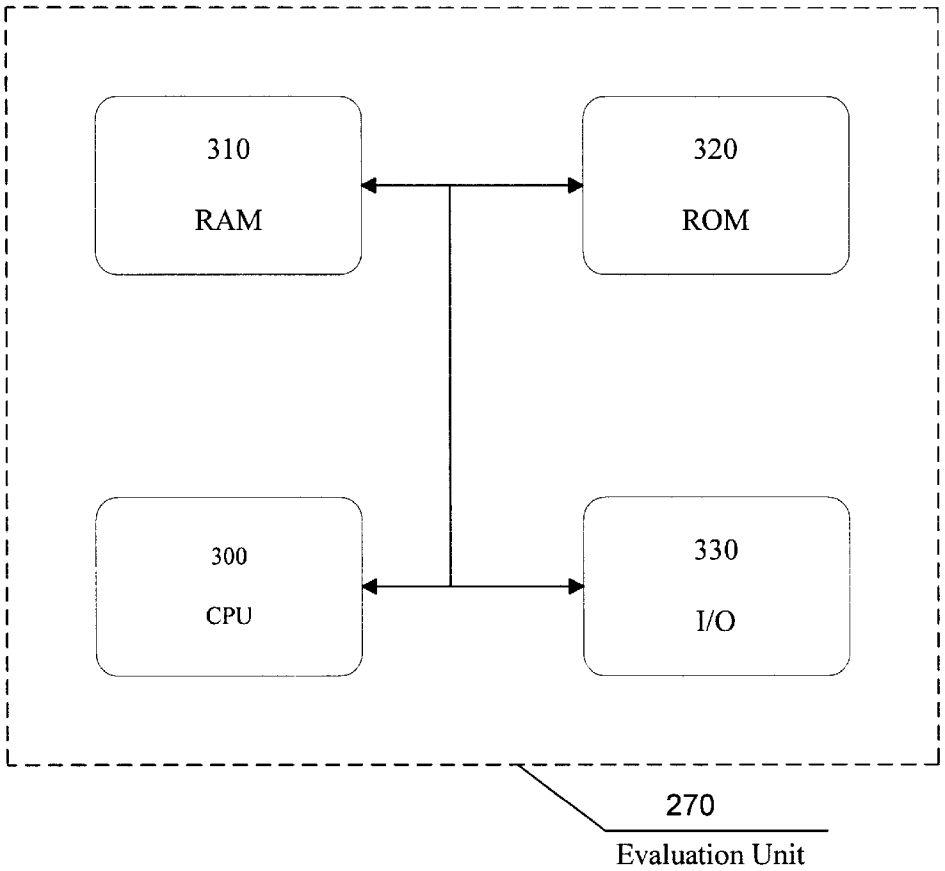
FIG. 3 is a block diagram of the evaluation unit illustrated in FIG. 2.

The architecture of the evaluation unit 270 is a conventional Von Neumann machine architecture as illustrated in FIG. 3. It comprises Random Access Memory (RAM) 310, Read Only Memory (ROM) 320, Central Processing Unit (CPU) 300 and Input Output (I/O) device 330.

Figure 4:
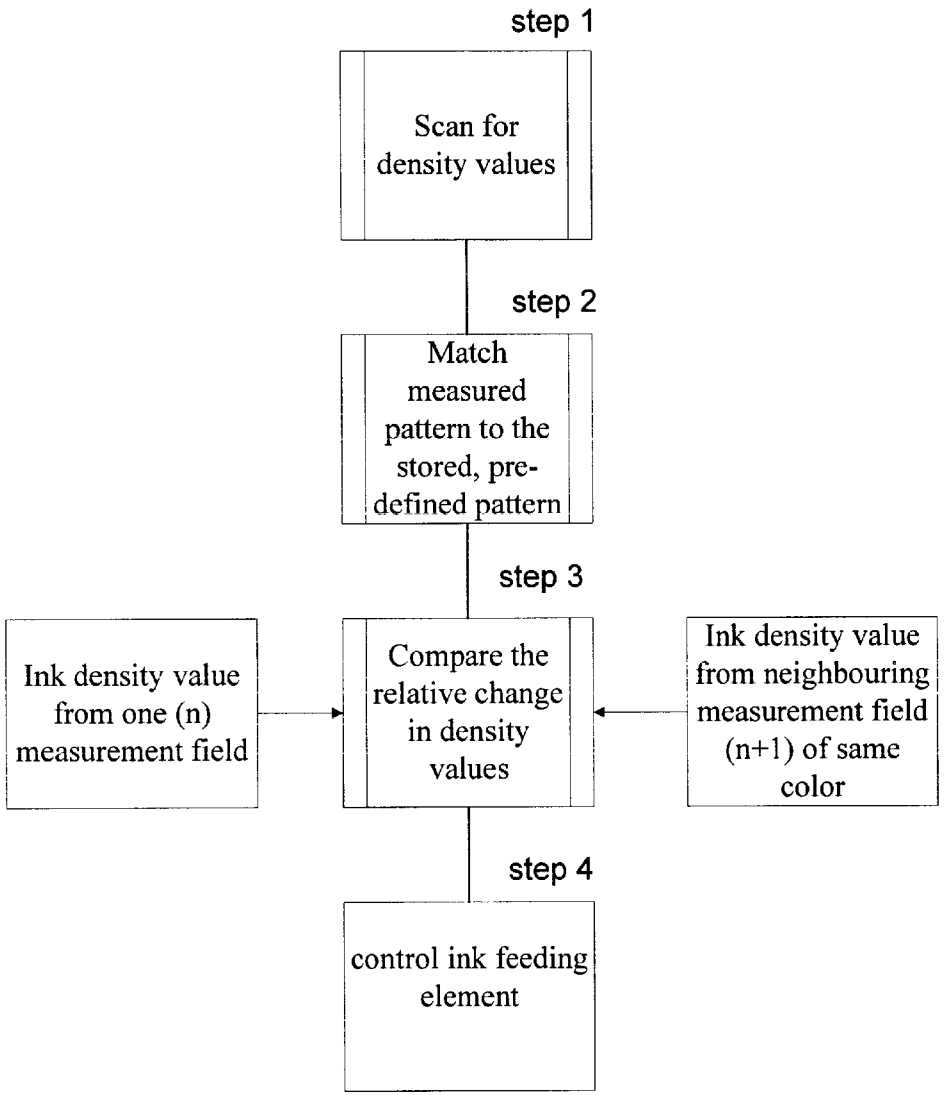
FIG. 4 is a diagram illustrating the function of the evaluation unit.

FIG. 4 illustrates the functions of the evaluation unit 270. First, the measuring head 160 scans the measuring strip 130 and provides collected data to the evaluation unit 270 for determining the density values of the measurement fields 120. Second, the evaluation unit 270 matches the measured pattern of the density to the stored, pre-defined density pattern of the colors on the strip. The evaluation unit 270 compares the ink density value of one measurement field with the ink density value from the neighboring measurement field of the same color. Third, the unit 270 matches the measuring fields 120 with ink feeding elements 291. Fourth, the variable described above is calculated for use in controlling the metering of ink to the printed sheet by way of the ink feeding elements 291. It calculates the relative change value of $4\cdot(D_{n+1}-D_n)^2/(D_{n+1}+D_n)^2$, where $D_n$ represents the ink density value of the nth measurement field. Results from the comparison are used to properly control the application of the ink.

All of the references cited herein, including the above-identified German and European patents are hereby incorporated in their entireties by reference.

In view of the many possible embodiments to which the principles of this invention may be applied, it should be recognized that the embodiment described herein with respect to the drawing figures is meant to be illustrative only and should not be taken as limiting the scope of invention. For example, those of skill in the art will recognize that the elements of the illustrated embodiment shown in software may be implemented in hardware and vice versa or that the illustrated embodiment can be modified in arrangement and detail without departing from the spirit of the invention. Therefore, the invention as described herein contemplates all such embodiments as may come within the scope of the following claims and equivalents thereof.

What is claimed is:

1. An apparatus for the densitometric measurement of colored printed sheets produced on sheet-fed offset printing machines, having a densitometric measuring head moveable along a measurement strip comprising a number of measurement fields of one type and whose signals can be converted in a downstream evaluation unit into ink density values that are assigned to ink metering zones, the evaluation unit containing in a memory information about the arrangement of the measurement fields of colors for the printed sheets in individual metering zones and a comparator in which the ink density values from one measurement field are compared to the ink density values from neighboring measurement fields of the same color and type in keeping with the arrangement of the fields on the measurement strip.

2. The apparatus according to claim 1, wherein the evaluation unit assigns the measurement fields to the individual ink metering zones.

3. The apparatus according to claim 1, wherein in order to compare the ink density value ($D_n$) from one measurement field of the zone (n) with the ink density value ($D_{n+1}$) from a measurement field in a neighboring zone (n+1), the evaluation unit calculates the variable $4\cdot(D_{m+1}-D_n)^2/(D_{n+1}+D_n)^2$.

* * * * *